US005240825A

United States Patent [19]

Jones et al.

[11] Patent Number: 5,240,825

[45] Date of Patent: Aug. 31, 1993

[54] PREPARATION OF SILVER HALIDE GRAINS

[75] Inventors: Cynthia G. Jones, Bergen; Terrie L. Osborne-Perry, Rochester; Sabet K. Salib, Rochester; Mark E. Irving, Rochester; Ramesh Jagannathan, Rochester, all of N.Y.

[73] Assignee: Eastman Kodak Company, Rochester, N.Y.

[21] Appl. No.: 864,282

[22] Filed: Apr. 6, 1992

[51] Int. Cl.[5] ..... G03C 1/015

[52] U.S. Cl. ..... 430/569; 430/567

[58] Field of Search ..... 430/567, 569

[56] References Cited

U.S. PATENT DOCUMENTS

| | | | |
|---|---|---|---|
| 3,966,476 | 6/1976 | Becker | 96/107 |
| 4,309,501 | 1/1982 | Huguenard et al. | 430/569 |
| 4,623,612 | 11/1986 | Nishikawa et al. | 430/375 |
| 4,710,455 | 12/1987 | Iguchi et al. | 430/567 |
| 4,713,323 | 12/1987 | Maskasky | 430/569 |
| 4,804,621 | 2/1989 | Tufano et al. | 430/567 |
| 4,879,208 | 11/1989 | Urabe | 430/569 |
| 4,916,052 | 4/1990 | Irving | 430/567 |
| 4,927,745 | 5/1990 | Irving | 430/567 |
| 4,952,491 | 8/1990 | Nishikawa et al. | 430/570 |
| 4,962,015 | 10/1990 | Aida et al. | 430/572 |
| 5,009,991 | 4/1991 | Mowforth et al. | 430/567 |

*Primary Examiner*—Janet C. Baxter
*Attorney, Agent, or Firm*—Carl O. Thomas

[57] ABSTRACT

The present invention relates to a process of preparing radiation sensitive silver halide grains containing at least 90 mole % silver iodide and having a morphological configuration of four hexagonal bipyramids each with bases joined to form a common tetrahedron. With this process, the hexagonal bipyramid portion of the grains can be elongated and/or truncated. In addition, the fraction of silver halide grains which have a configuration of four hexagonal bipyramids is increased.

7 Claims, 3 Drawing Sheets

PREPARATION OF SILVER HALIDE GRAINS

FIELD OF THE INVENTION

The present invention relates to the preparation of silver iodide grains having the morphological configuration of four hexagonal bipyramids, the four bases of which are joined to form a common tetrahedron.

BACKGROUND OF THE INVENTION

Radiation-sensitive silver iodide emulsions, though infrequently employed in photography, are known in the art Silver halide emulsions which employ grains containing silver iodide as a separate and distinct phase are illustrated in: German Patent No. 505,012; Steigmann, "Green-and Brown-Developing Emulsions," *Photographische Industrie,* vol. 34, pp. 764, 766, and 872; U.S. Pat. Nos. 4,094,684 and 4,142,900; U.K. Patent Application No. 2,063,499A; and *Research Disclosure,* Vol. 18153, May 1979. The Research Disclosure reference describes silver iodide phosphate Photographic emulsions in which silver is coprecipitated with iodide and phosphate. A separate silver iodide phase in not reported.

The crystalline configurations for silver iodide are not as well publicized primarily, because silver iodide emulsions are of limited direct utility in many photographic systems. However, crystalline structures of silver iodide have been studied by crystallographers, particularly by those interested in photography. As illustrated by Byerley and Hirsch, "Dispersions of Metastable High Temperature Cubic Siliver Iodide", *Journal of Photographic Science,* vol. 18, 1970, pp. 53–59, it is generally recognized that silver iodide is capable of existing in three different crystal forms. The most commonly encountered form of silver iodide crystals is the hexagonal wurtzite type, designated $\beta$ phase silver iodide Silver iodide is also stable at room temperature in its face centered cubic crystalline form, designated $\gamma$ phase silver iodide A third form of crystalline silver iodide, stable only at temperatures above about 147° C., is the body centered cubic form designated $\alpha$ phase silver iodide. The $\beta$ phase is the most stable form of silver iodide It was previously believed that more nearly cubic AgI was precipitated when silver ions were in excess and more nearly hexagonal AgI resulted when iodide ions were in excess. More recent measurements, however, indicated that the presence or absence of gelatin and the rate of addition of the reactants had pronounced effects on the amounts of cubic and hexagonal AgI. Entirely hexagonal material was produced only when gelatin was present and the solutions were added slowly without an excess of either silver or iodide. No condition was found where only cubic material was observed.

Plate-like silver iodide crystals have been observed. Preparations with an excess of iodide ions, producing hexagonal crystal structures of predominantly $\beta$ phase silver iodide are reported by Ozaki and Hachisu, "Photophoresis and Photoagglomeration of Plate-like Silver Iodide Particles," *Science of Light,* vol. 19, No. 2, 1970, pp. 59–71 and by Zharkov, Dobroserdova, and Panfilova, "Crystallization of Silver Halides in Photographic Emulsions IV, Study by Electron Microscopy of Silver Iodide Emulsions," *Zh. Nauch. Prikl. Fot. Kine.,* Mar.–Apr., 1957, 2 pp. 102–105.

The morphologies of truncated hexagonal pyramidal and hexagonal bipyramidal silver iodide grains are described by Daubendiek in "AgI Precipitations: Effects of pAg on Crystal Growth (PB) III-23", *Papers from the* 1978 *International Congress of Photographic Science,* Rochester, N.Y., pp. 140–142. The bipyramid silver iodide crystals are described as being useful precursors for silver chloroiodide, chlorobromoiodide, and bromoiodide emulsions in U.S. Pat. Nos. 4,094,684, 4,150,994, 4,184,877, 4,184,878, and 4,414,310.

U.S. Pat. No. 4,094,684 describes composite crystals obtained by deposition of a silver salt epitaxially onto silver iodide grains. Particularly described is the deposition of silver chloride onto silver iodide host grains to obtain multi-faceted silver iodide crystals having a minimum mean diameter of at lease 0.1 micron and silver chloride crystals forming epitaxial junctions with the silver iodide crystals. At least one half of the facets of the silver iodide crystals are substantially free of epitaxial silver chloride.

U.S. Pat. No. 4,150,994 describes the preparation of silver iodobromide or of silver iodochloride emulsions, utilizing an Ostwald ripening step, which produces silver halide grains of the twinned octahedral or cubic type. This patent describes silver iodide seed grains. However, it neither teaches nor suggests a process for the preparation of silver halide grains, which grains comprise at least 90 mol percent iodide.

U.S. Pat. Nos. 4,184,877 and 4,184,878 are similar to the U.S. Pat. No. 4,150,994 and describe preparation, without use of an Ostwald ripening step, of twinned silver halide crystals formed from silver iodide grains which are predominantly of the hexagonal type. U.S. Pat. No. 4,184,877 follows the procedure of U.S. Pat. No. 4,150,994 but also includes the step of chemically sensitizing the silver halide grains.

U.S. Pat. No. 4,414,310 is directed to a process for preparing tabular grain silver bromoiodide emulsions by concurrently introducing silver and bromide salts into a reaction vessel containing an emulsion comprising a dispersing medium and high iodide silver halide grains. Prior to concurrent introduction of silver and bromide salts, the mean diameter of the high iodide silver halide grains is limited to less than 0.1 micron and the concentration of iodide is limited to less than $10^{-2}$ mole per liter.

U.S. Pat. No. 4,490,458 describes multicolor photographic elements which contain superimposed emulsion layers for separately recording blue and minus blue light. The elements include at least one emulsion layer comprised of a dispersing medium and silver halide grains, wherein at least 50 percent of the total projected area of the silver halide grains is provided by thin tabular silver iodide grains having a thickness of less than 0.3 micron and an average aspect ratio of greater than 8:1. The multicolor photographic elements show advantages in the minus blue recording emulsion layers directly attributable to the thin tabular silver iodide grains.

U.S. Pat. Nos. 4,916,052 and 4,927,745 relate to a process for preparation of radiation sensitive silver iodide grains which have the morphological configuration of four hexagonal bipyramids in which their four bases are joined to form a common tetrahedron. This process comprises the steps of:

(a) forming in a colloid dispersing medium silver halide grains containing at least 90 mole Percent iodide by homogeneous nucleation at a pAg value of from about 11.0 to about 5.0 at a temperature between about 30° and 90° C.;

(b) maintaining these conditions until the silver iodide grains are from about 0.005 to about 0.5 μm in diameter;

(c) altering the growth environment of the silver iodide grains to a pAg value of from about 13.5 to about 9.8 at a temperature from about 30° to about 90° C., and, optionally;

(d) removing water soluble salts formed during the precipitation process

Although this procedure effectively produces silver iodide grains of the desired configuration, it is desirable to better control the production of either elongated or truncated grains. In addition, the ratio of grains having the desired tetrahedral configuration of 4 hexagonal bipyramids to grains with a single hexagonal bipyramid morphology or with other undesired forms is too low for commercial utility. There is thus a need to improve this process.

SUMMARY OF THE INVENTION

The present invention relates to a process of preparing radiation-sensitive silver halide grains having a morphological configuration of four hexagonal bipyramids each with bases joined to form a common tetrahedron. Homogeneous silver iodide grains containing at least 90 mole % iodide are first nucleated in a colloidal dispersing medium having a pAg of about 5.0–11.0 and a temperature of about 30°–90° C.. These nucleating conditions are maintained until the silver iodide grains have grown to about 0.005–0.5 μm in diameter. The silver iodide grains are then subjected to an adjusted growth medium having a pAg of about 9.8–13.5 and a temperature of about 30°–90° C. This causes the grains to undergo growth to a diameter of about 0.01 to 5.0 μm.

In one form of the present invention, the silver iodide grains are subjected to the adjusted growth medium at a temperature of 35°–55° C. This yields grains configured as four elongated, untruncated hexagonal bipyramids each with bases joined to form a common tetrahedron.

In another aspect of the present invention, the step of subjecting the silver iodide grain to an adjusted growth medium is temporarily stopped by discontinuing addition of silver and iodide to the growth medium. The growth medium is then maintained at conditions suitable to increase the ratio of silver halide grains configured with four hexagonal bipyramids each with bases joined to form a common tetrahedron to silver halide grains having other configurations. After such growth medium conditions are maintained for a suitable period, the step of subjecting the silver iodide grains to an adjusted growth medium is resumed.

Another aspect of the present invention relates to terminating the step of subjecting the silver iodide grains to an adjusted growth medium by subjecting the growth medium to a temperature of 65°–80° C. for a brief period of time. This procedure truncates the hexagonal bipyramids which advantageously then can be subjected to epitaxial growth, in accordance with U.S. Pat. No. 4,916,052 to produce hollow silver halide grains. It is desirable to carry out the step of subjecting the silver halide grains to 65°–90° C. in a growth medium containing 10 to 600 grams of gelatin per mole of silver.

DETAILED DESCRIPTION OF THE DRAWINGS AND THE INVENTION

Figure 1:
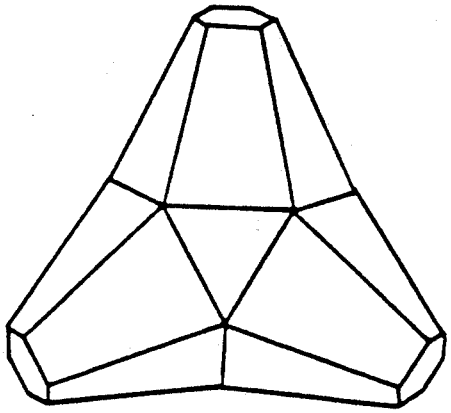
FIG. 1 (PRIOR ART)
FIG. 1 illustrates a silver halide grain resulting from a control process as described in the Daubendiek 1978 International Congress of Photographic Science paper noted above.
Figure 2:
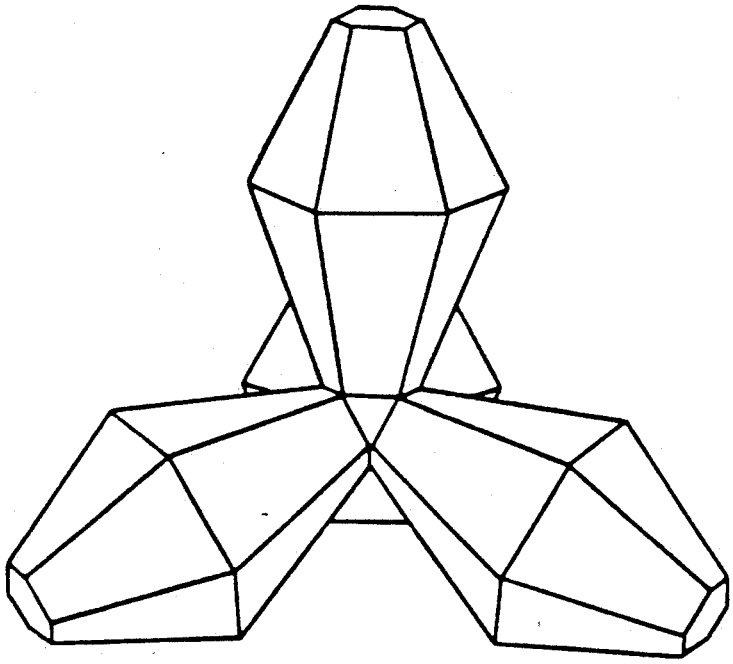
FIG. 2 illustrates a silver iodide grain produced by the process of the present invention, which grain comprises four truncated hexagonal bipyramids with their four bases being joined to form a common tetrahedron.
Figure 3:
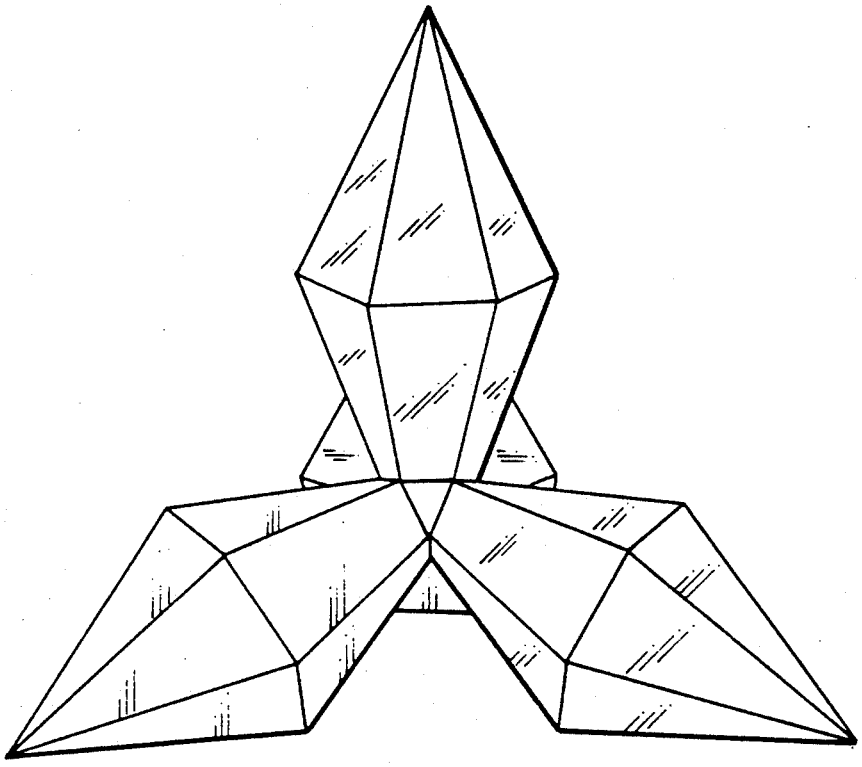
FIG. 3 illustrates a silver iodide grain produced by the process of the present invention which comprises four elongated, untruncated hexagonal bipyramids with their bases being joined to form a common tetrahedron.

Silver halide grains produced in accordance with this invention comprise at least 90 mole percent silver iodide. The grains consist of a central region from which four hexagonal bipyramids extend at the tetrahedral angle of 109.5° . In one embodiment of the present invention, the basal planes of the grains are truncated, as shown in FIG. 2. In another embodiment, the crystals are elongated and not truncated, as shown in FIG. 3. The principal differences between these configurations and the FIG. 1 configuration are the relative sizes of the central region and protruding legs and the morphology of the individual legs resulting from the respective processes by which they are manufactured. Also, the protrusions extending from the grains described in the Daubendiek publication noted above are distinguishable, because they comprise single hexagonal pyramids U.S. Pat. No. 4,927,745, which is hereby incorporated by reference, discloses a procedure for preparing silver halide grains configured in accordance with FIGS. 2 and 3. The Present invention relates to an improved process of preparing such radiation-sensitive silver halide grains having a morphological configuration of four hexagonal bipyramids each with bases joined to form a common tetrahedron.

Homogeneous silver iodide grains containing at least 90 mole % iodide are first nucleated in a colloidal dispersion medium having a pAg of about 5.0–11.0 and a temperature of about 30°–90° C. It is Particularly preferred that such nucleation be carried out a pAg of 5.8–8.4 and a temperature of 30°–40° C. During such nucleating, desired pAg ranges are maintained by injection of silver ions and iodide ions into a dispersing medium. Such nucleating conditions are maintained until the silver iodide grains have grown to about 0.005 to about 0.5 μm in diameter.

After nucleation, the silver iodide grains are subjected to an adjusted growth medium having a pAg of about 9.8–13.5 and a temperature of about 30°–90° C. to promote growth of grains having the configurations shown in FIGS. 2 and 3. The grains are then allowed to grow by injecting silver ions and iodide ions into the growth medium. It is particularly desirable that the growth medium be maintained at a pAg of 10.9–13.5. To produce silver halide grains ultimately configured with four elongated, untruncated hexagonal bipyramids, each with bases joined to form a common tetrahedron, as shown in FIG. 3, the growth medium should be maintained at a temperature of 35°–55° C.

During such growth, it is advantageous to discontinue silver ion and iodide ion addition to the growth medium and to maintain the medium at conditions suitable to increase the ratio of silver halide grains configured as four hexagonal bipyramids each with bases joined to form a common tetrahedron to other silver halide grain configurations, such as single hexagonal bipyramids. By temporarily discontinuing growth of the silver iodide grains, the growth medium is able to digest grains other than those configured as four hexagonal bipyramids each with bases joined to form a common tetrahedron. As a result, the percentage of such other grain configurations in the growth medium is reduced. It is particularly desirable to increase the ratio of grains configured as 4 hexagonal bipyramids joined as a tetrahedron to other grain configurations such as single hexagonal bipyramids, preferably to about 3:1 or greater. Such results can be achieved by maintaining the growth medium at a temperature of 60°-90° C. for period of at least 5 minutes.

The fraction of silver halide grains having a configuration of four hexagonal bipyramids with bases joined to form a common tetrahedron also can be increased during growth by using a high level of gelatin in the growth medium. Specifically, the growth medium should contain gelatin in the amount of 10 to 1000 grams per mole of silver, preferably 25 to 300 grams per mole of silver.

Following the digestion step, growth of the silver iodide grains in the adjusted growth medium having a pAg of 9.8-13.5 and a temperature of 30°-90° C., preferably 35°-55° C., can be resumed. This is again, carried out by injecting silver ions and iodide ions into the growth medium It is preferable that 5 mole percent to 50 mole percent of the silver ions and iodide ions added during growth (i.e., after nucleation and partial growth to a grain diameter of 0.005-0.5 μm) take place after the digestion step. This produces elongated, untruncated bipyramids in the grain products, as shown in FIG. 3.

As noted above, it may be desirable to produce silver iodide grains with a configuration of four hexagonal bipyramids with truncated ends and having bases joined to form a common tetrahedron, as shown in FIG. 2. This can be achieved by elevating the temperature of the growth medium for a brief period of time during the final stages of growth. During this final stage of growth, silver and iodide ions continue to be added to the growth medium Specifically, the growth medium should be elevated to a temperature of 65°-90° C., preferably 70° C., for the last 2 to 25 percent, preferably 5 Percent, of the total silver addition during growth.

The silver iodohalide (at least 90 mol % iodide) grains produced in accordance with the process of this invention have, as noted above, a complex configuration. Such grains are advantageous in that they present a high surface area and, therefore, have a favorable surface area to volume ratio. This property is particularly advantageous with respect to both spectral sensitization and development.

The portion of other halides which make up the 10 or less mole percent of halides present in the silver iodohalide grains of the present invention can be bromide, chloride, or a mixture thereof These other halides may be present in the silver iodide crystals without affecting their morphology or they may be deposited epitaxially.

It is desirable to nucleate and grow silver iodide crystals in accordance with the present invention in the presence of a silver halide solvent. Such solvents may be incorporated within the dispersing medium in the reaction vessel before silver and halide salt addition, introduced into the reaction vessel with one or more of the halide salt, silver salt, or Peptizer, or independently introduced during halide and silver salt addition.

Preferred silver halide solvents are those containing sulfur, such as thiocyanates, thioethers, and thioureas. Suitable thiocyanate salts are alkali metal (e.g., sodium and potassium) thiocyanates and ammonium thiocyanate. While any conventional quantity of the thiocyanate salts can be introduced, preferred concentrations are generally from about 0.1 to 20 grams of thiocyanate salt per mole of silver halide. Such use of thiocyanates is disclosed in U.S. Pat. Nos. 2,222,264, 2,448,534, and 3,320,069 which are hereby incorporated by reference. The use of thioethers disclosed in U.S. Pat. Nos. 3,271,157, 3,531,289, 3,574,628, 3,737,313, 4,311,638; 4,725,560, 3,767,413, 3,531,289, and 4,749,646 which are hereby incorporated by reference. Useful thiourea solvents include those described in U.S. Pat. Nos. 4,284,717, 4,568,635, 4,695,534, 4,635,535, 4,713,322, and 4,749,646. Other known potentially useful silver halide solvents include ammonia or an excess of halide ions.

Various modifying compounds can be present during grain nucleation and growth. Such compounds can be initially in the reaction vessel or can be added along with one or more of the salts according to ,; conventional procedures. Suitable modifying compounds are compounds of copper, thallium, lead, bismuth, cadmium, zinc, middle chalcogens (i.e., sulfur, selenium and tellurium), gold and Group vIII noble metals. The use of modifying compounds is illustrated by U.S. Pat. Nos 1,195,432, 1,951,933, 2,448,060, 2,628,167, 2,950,972, 3,488,709, 3,737,313, 3,772,031, and 4,269,927 and *Research Disclosure,* Vol. 134, June 1975, Item 13452. *Research Disclosure* and its predecessor, *Product Licensing Index,* are publications of Kenneth Mason Publications Limited; Emsworth, Hampshire P010 7DD; United Kingdom.

The individual silver and halide salts can be added to the reaction vessel through surface or subsurface delivery tubes, by gravity feed, or by delivery apparatus for maintaining control of the rate of delivery and the pH, pBr, and/or pAg of the reaction vessel contents. This is illustrated by U.S. Pat. Nos. 3,821,002 and 3,031,304 and in Claes et al., *Photographische Korresondenz,* Band 102, Number 10, 1967, p. 162 In order to obtain rapid distribution of the reactants within the reaction vessel, specially constructed mixing devices can be employed. See U.S. Pat. Nos. 2,996,287, 3,342,605, 3,415,650, 3,785,777, 4,147,551, and 4,171,224, U.K. patent application No. 2,022,431A, German OLS Nos. 2,555,364 and 2,556,885, and *Research Disclosure,* Volume 166, Feb. 1978, Item 16662.

In forming emulsions, the reaction vessel should initially contain a dispersing medium, preferably an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and, after fully forming the silver halide grains, to adjust the emulsion vehicle concentration upwardly for optimum coating characteristics. However, as noted supra, it may be desirable to increase the peptizer level during growth when forming truncated grains, as shown in FIG. 2. It is contemplated that the emulsion as initially formed will contain from about 10 to 1000 grams of peptizer per mole of silver halide, preferably about 25 to 300 grams of peptizer per mole of silver halide. Additional vehicle can be added after growth of the silver iodide grains is completed to bring the concentration up to as high as 1000 grams per mole of silver halide. Preferably, the concentration of vehicle in the finished emulsion is above 50 grams per mole of silver halide. When coated and dried on a photographic element the vehicle preferably forms about 30 to 70 weight percent of each emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives (e.g., cellulose esters), gelatin (e.g., alkali-treated gelatin [cattle bone or hide gelatin]) or acid-treated gelatin (pigskin gelatin), gelatin derivatives (e.g., acetylated gelatin, phthalated gelatin and the like), polysaccharides (e.g., dextran), gum arabic, zein, casein, pectin, collagen derivatives, agaragar, arrowroot, albumin, and the like, as described in U.S. Pat. Nos 2,614,928, 2,614,929, 2,691,582, 2,614,930, 2,614,931, 2,327,808, 2,448,534, 2,787,545, 2,956,880, 3,061,436, 2,816,027, 3,132,945, 3,138,461, 3,186,846, 2,960,405, 3,436,220, 3,486,896, 2,992,213, 3,157,506, 3,184,312 3,539,353, 3,227,571, 3,532,502, 3,551,151, and 4,018,609.

Other materials commonly employed in combination with hydrophilic colloid peptizers as vehicles (including vehicle extenders—e.g., materials in the form of lattices) include synthetic polymeric peptizers, carriers and/or binders such as poly(vinyl lactams) acrylamide polymers, polyvinyl alcohol and its derivatives, polyvinyl acetals, polymers of alkyl and sulfoalkyl acrylates and methacrylates, hydrolyzed polyvinyl acetates, Polyamides, polyvinyl pyridine, acrylic acid polymers, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkyliminoalkyl acrylates, vinyl imidazole copolymers, vinyl sulfide copolymers, halogenated styrene polymers, amineacrylamide polymers, polypeptides, and the like, as described in U.S. Pat. Nos. 3,679,425, 3,706,564, 3,813,251, 2,253,078, 2,276,322, 2,276,323, 2,281,703, 2,311,058, 2,414,207, 2,484,456, 2,541,474, 2,632,704, 3,425,836, 3,415,653, 3,615,624, 3,488,708, 3,392,025, 3,511,818, 3,681,079, 3,721,565, 3,852,073, 3,861,918, 3,925,083, 3,879,205, 3,142,568, 3,062,674, and 3,220,844. These additional materials need not be present in the reaction vessel during silver halide nucleation and growth, but rather are conventionally added to the emulsion prior to coating.

The emulsions are preferably washed to remove soluble salts. The soluble salts can be removed by decantation, filtration, and/or chill setting and leaching, as illustrated by U.S. Pat. Nos. 2,316,845 and 3,396,027, by coagulation washing, as illustrated by U.S. Pat. Nos. 2,618,556, 2,614,928, 2,565,418, 3,241,969, and 2,489,341, by centrifugation and decantation of a coagulated emulsion, as illustrated by U.S. Pat. Nos. 2,463,794, 3,707,378, 2,996,287, and 3,498,454, and by employing hydrocyclones alone or in combination with centrifuges, as illustrated by U.K. Patent Nos. 1,336,692, 1,356,573, and by Ushomirskii et al. Soviet Chemical Industry, Vol. 6, No. 3, 1974, pp. 181-185. The emulsions, with or without sensitizers, can be dried and stored prior to use as illustrated by *Research Disclosure*, Vol. 101, Sept. 1972, Item 10151. Washing is particularly advantageous after the completion of silver iodide growth.

The silver halide emulsions employed in this invention can be sensitized by conventional techniques. A preferred chemical sensitization technique is to deposit a silver salt epitaxially onto the grains. The epitaxial deposition of silver chloride onto silver iodide host grains is taught by U.S. Pat. Nos. 2,094,684 and 4,142,900 and the analogous deposition of silver bromide onto silver iodide host grains is taught by U.K. Patent Application No. 2,053,499A, each cited above and hereby incorporated by reference.

The sensitizing silver salt that is deposited onto the grains at selected sites can be chosen from among any silver salt capable of being epitaxially grown on a silver halide grain and heretofore known to be useful in photography. The anion content of the silver salt and the silver iodide are sufficiently different to permit detection of such differences in the respective crystal structures. It is specifically contemplated to choose the silver salts from among those heretofore known to be useful in forming shells for core-shell silver halide emulsions. In addition to all the known photographically useful silver halides, the silver salts can include other silver salts known to be capable of precipitating onto silver halide grains, such as silver thiocyanate, silver cyanide, silver carbonate, silver ferricyanide, silver arsenate or arsenite, and silver chromate Silver chloride is a specifically preferred sensitizer. Depending upon the silver salt chosen and the intended application, the silver salt can usefully be deposited in the presence of any of the modifying compounds described above or with sensitizing dyes described below. Some iodide from the host grains may enter the silver salt epitaxy. It is also contemplated that the host grains can contain anions other than iodide up to their solubility limit in silver iodide, and, as employed herein, the term "silver iodide grains" is intended to include such host grains.

Conventional chemical sensitization can be undertaken prior to controlled site epitaxial deposition of silver salt on the host silver iodide grain or as a following step. When silver chloride and/or silver thiocyanate is deposited, a large increase in sensitivity is realized merely by selective site deposition of the silver salt. Thus, further chemical sensitization steps of a conventional type need not be undertaken to obtain photographic speed. On the other hand, an additional increment in speed can generally be obtained when further chemical sensitization is undertaken, and it is a distinct advantage that neither elevated temperature nor extended holding times are required in finishing the emulsion. The quantity of sensitizers can be reduced, if desired, where (1) epitaxial deposition itself improves sensitivity or (2) sensitization is directed to epitaxial deposition sites.

Any conventional technique for chemical sensitization following controlled site epitaxial deposition can be employed. In general, chemical sensitization should be undertaken based on the composition of the silver salt deposited rather than the composition of the host grains since chemical sensitization is believed to occur primarily at the silver salt deposition sites or perhaps immediately adjacent thereto Conventional techniques for achieving noble metal (e.g., gold), middle chalcogen (e.g., sulfur, selenium, and/or tellurium), or reduction sensitization as well as combinations thereof are disclosed in *Research Disclosure,* Item 17643, Paragraph III.

In one preferred form, chemical sensitization is undertaken after spectral sensitization. Similar results have also been achieved in some instances by introducing other adsorbable materials, such as finish modifiers, into the emulsion prior to chemical sensitization. Independent of the prior incorporation of adsorbable materials, it is preferred to employ thiocyanates during chemical sensitization in concentrations of from about $2\times10^{-3}$ to 2 mole percent, based on silver, as taught by U.S. Pat. No. 2,462,361. Other silver halide solvents can be used during chemical sensitization. Still a third approach, capable of being practiced independently of, but compatible with, the two approaches described above, is to deposit silver salts epitaxially as taught in U.S. Pat. No. 4,435,501, herein incorporated by reference.

Silver iodide emulsions record blue light and need not be spectrally sensitized in the blue portion of the spectrum. However, it is advantageous to extend the blue sensitivity of silver iodide by use of sensitizing dyes. This is particularly true for high surface area to volume grains such as those of the present invention. Silver bromide and silver bromoiodide emulsions can be employed to record blue light without incorporating blue sensitizers, although their absorption efficiency is much higher when blue sensitizers are present. The silver halide emulsions, regardless of composition, intended to record minus blue light are spectrally sensitized to red or green light by the use of spectral sensitizing dyes.

The silver halide emulsions of this invention can be spectrally sensitized with dyes from a variety of classes, including the polymethine dye class, which classes include the cyanines, merocyanines, complex cyanines and merocyanines (i.e., tri-, tetra-, and poly-nuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolinium, thiazolinium, selenazolium, selenazolinium, imidazolium, imidazolinium, benzoxazolium, benzothiazolium. benzoselenazolium, benzimidazolium, naphthoxazolium, naphthothiazolium, naphthoselenazolium, dihydronaphthothiazolium, pyrylium and imidazopyrazinium quaternary salts.

The merocyanine spectral sensitizing dyes include those joined by a double bond or a methine linkage, a basic heterocyclic nucleus of the cyanine dye type and an acidic nucleus, as can be derived from barbituric acid, 2-thiobarbituric acid, rhodanine, hydantoin, 2-thiohydantoin, 4-thiohydantoin, 2-pyrazolin-5-one, 2-isoxazolin-5-one,indan-1,3-dione, cyclohexane-1,3-dione, 1,3-dioxane-1,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired.

Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—i.e. spectral sensitization that is greater in some spectral region than from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners, and antistatic agents Any one of several mechanisms as well as compounds which can be responsible for supersensitization are discussed by Gilman, "Review of the Mechanisms of SupersensitizatiOn," *Photographic Science and Engineering,* vol. 18, 1974, pp. 418–430.

Preferred spectral sensitizing dyes are described in greater detail in U.S. Pat. No. 4,490,458, the disclosure of which is hereby incorporated by reference.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain growth, as taught by U.S. Pat. Nos. 3,628,960 and 4,225,666. As taught by U.S. Pat. No. 4,225,666, introduction of the spectral sensitizing dye into the emulsion is spaced so that a portion of it is present prior to chemical sensitization and a remaining portion is introduced after chemical sensitization. Alternatively, it is possible to add the spectral sensitizing dye during growth. Sensitization can be enhanced by pAg adjustment, including variation in pAg which completes one or more cycles, during chemical and/or spectral sensitization. A specific example of pAg adjustment is provided by *Research Disclosure,* vol. 181, May 1979, Item 18155.

EXAMPLES

Example 1

To an 8 L vessel, 30 g gelatin and 300 cc distilled water were added. The resulting solution was adjusted to a temperature of 35° C., and the pAg was adjusted to 6.5 using 0.01 $MAgNO_3$. 3000 cc of a 1.0 M KI solution and 3000 cc of a 1.0 $MAgNO_3$ solution were prepared and added to the vessel using a double-jet technique with pAg control with an addition rate of 1 cc/min for 5 min. Next, 20 g of gelatin was dissolved in 500 cc of distilled water, and this solution was added to the vessel.

Partial growth of the crystals was achieved by utilizing an accelerated double jet flow scheme as outlined below:

| Segment Time | Start Flowrate | End Flowrate |
|---|---|---|
| 20 min | 1.0 cc/min | 1.0 cc/min |
| +120 min | 1.0 cc/min | 5.0 cc/min |
| +120 min | 5.0 cc/min | 9.0 cc/min |

After completion of this growth schedule, the emulsion was washed and concentrated to 1.19 kg/mole Ag. A 0.1 μm AgI seed emulsion remained.

Into an 18 L stirred reactor were introduced 5,000 cc distilled water, 100 g gelatin, and 8.3 g KI. The gelatin and KI were dispersed at 70° C. 0.004 moles of the AgI 0.1 μm seed emulsion, prepared as described in the preceding paragraph, was then melted and added to the vessel. While controlling the vessel pAg at 11.3 at 70° C., 50 cc/min of 0.5 $MAgNO_3$ and 12.5 cc/min of 2 MKI were simultaneously added over a period of 5 minutes at constant flow rates to effect the growth stage. The $AgNO_3$ flow rate was then linearly increased to 140 cc/min and the KI to 35 cc/min over a period of 83 min. The emulsion was then washed and concentrated.

EXAMPLE 2

An emulsion was prepared as in Example 1, except that 0.02 moles of the 0.1 μm AgI seed emulsion was used for growth, and the entire growth stage was carried out at 55° C. instead of 70° C. The reactor pAg was controlled at its initial value of 11.8.

An emulsion was prepared as in Example 2, except that 0.15 moles of the 0.1 μm AgI seed emulsion was added and the entire precipitation was carried out at 40° C. instead of 70° C. during the growth stage. The reactor pAg was controlled at its initial value of 13.0 at 40° C. Visual examination of scanning electron micrographs, at magnifications of 1000 to 10,000×, of the emulsions of Examples 1-3 showed that they all largely contained crystals having the tetrahedral configuration of four hexagonal bipyramids, as described in U.S. Pat. 4,927,745. However, the emulsion of Example 1 mainly contained blunt crystals of about 1.25 μm average diameter The emulsion of Example 2 contained more elongated bipyramid configurations of about 0.8 μm diameter. The emulsion of Example 3 also contained more elongated configurations of about 0.6 μm in diameter. The use of lower growth temperatures thus produces silver iodide crystals having smaller, more elongated and pointed hexagonal bipyramid configurations.

Example 4

An emulsion was prepared as in Example 3, except that after 5 min of growth at 40° C., additions of 2 M KI and 0.5 $MAgNO_3$ were halted, and the emulsion was held for 30 minutes at 40° C. before the additions were completed.

Example 5

An emulsion was prepared as in Example 4, except that the emulsion was held at 70° C. instead of 40° C.

Examination of scanning electron micrographs of the emulsions of Examples 3 to 5 indicated that the number of single hexagonal bipyramid silver iodide grains was 40% in Example 3, 34% in Example 4, and 19% in Example 5. The discontinuation of silver and iodide addition and the holding step thus reduced the percentage of single hexagonal bipyramids, particularly when such holding was at 70° C.

Example 6

An emulsion was prepared as in Example 5 except that the growth temperature was raised from 40° C. to 70° C. for the last 90 sec of growth. The pAg during this period was controlled at 11.4.

Examination of scanning electron micrographs of the products of Examples 5 and 6 showed that the former produced pointed tips on the hexagonal bipyramids of the silver iodide tetrahedral hexagonal bipyramidal grains, while the latter yields bipyramids with truncated tips.

Example 7

To an 8 L vessel was added 30 g gelatin and 300 cc distilled water. The resulting solution was adjusted to a temperature of 35° C., and the pAg was adjusted to 6.5 using 0.01 $MAgNO_3$. 3000 cc of a 1.0 M KI solution and 3000 cc of a 1.0 $MAgNO_3$ solution were prepared and added to the vessel using a double-jet technique with pAg control with an addition rate of 1 cc/min for 5 min. Next, 20 g of gelatin was dissolved in 500 cc of distilled water, and this solution was added to the vessel.

Partial growth of the crystals was continued by utilizing an accelerated double jet flow scheme as outlined below:

| Segment Time | Start Flowrate | End Flowrate |
|---|---|---|
| 20 min | 1.0 cc/min | 1.0 cc/min |
| +120 min | 1.0 cc/min | 5.0 cc/min |
| +120 min | 5.0 cc/min | 9.0 cc/min |

After completion of this growth schedule, the emulsion was washed and concentrated to 1.19 kg per mole Ag. A 0.1 μm AgI seed emulsion remained.

Into an 18 L stirred reactor was introduced 5,000 cc distilled water, 100 g gelatin (25g/Ag mole), and 8.3 g KI. The gelatin and KI were dispersed at 70° C. 0.002 moles of an AgI 0.1 μm seed emulsion, prepared as described in the preceding paragraph, was melted and added to the vessel. While controlling the vessel pAg at 11.3 and temperature at 70° C., 50 cc/min of 0.5 $MAgNO_3$ and 12.5 cc/min of 2 MKI were simultaneously added over a period 5 min at a constant flow rate to effect the growth stage. The $AgNO_3$ flow rate was then linearly increased to 140 cc/min and the KI flow rate was raised to 35 cc/min over a period of 83 min. The percentage of grains configured with 4 hexagonal bipyramids joined at their bases by a tetrahedron, based on an examination of scanning electron micrographs, is shown in Table 1.

Example 8

An emulsion was prepared as in Example 7 except that the gelatin level was reduced to 6.25 g/Ag mole during the growth stage. The percentage of grains configured with 4 hexagonal bipyramids joined at their bases by a tetrahedron, based on an examination of scanning electron micrographs, is shown in Table 1.

Example 9

An emulsion was prepared as in Example 7 except that the gelatin level was increased to 75 g/Ag mole during the growth stage. The percentage of grains configured with 4 hexagonal bipyramids joined at their bases by a tetrahedron, based on an examination of scanning electron micrographs, is shown in Table 1.

Example 10

An emulsion was prepared as in Example 7 except that the gelatin level was increased to 150 g/Ag mole during the growth stage. The percentage of grains configured with 4 hexagonal bipyramids joined at their bases by a tetrahedron, based on an examination of scanning electron micrographs, is shown in Table 1.

TABLE 1

| Example | Percentage of Tetrahedral Hexagonal Bipyramids |
|---|---|
| 7 | 47 |
| 8 | 4 |
| 9 | 55 |
| 10 | 78 |

The results of Table 1 show that reducing the gelatin level at 70° C. reduces the number of desired grains configured with 4 hexagonal bipyramids joined at their bases to form a tetrahedron, while increasing the gelatin level has increased the percentage of desired grains.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A process of preparing an emulsion containing radiation sensitive silver halide grains having a morphological configuration of four hexagonal bipyramids, each with bases joined to form a common tetrahedron, comprised of the following sequential steps:

(a) nucleating homogeneous silver iodide grains containing at least 90 mol percent iodide in a colloidal dispersing medium under conditions wherein the pAg is in the range of from about 5.0 to 11.0 and the temperature is from about 30° C. to 90° C.;

(b) maintaining the nucleating conditions until the silver iodide grains are from about 0.005 to about 0.5 μm in diameter;

(c) introducing silver ions and iodide ions to grow the silver iodide grains in an adjusted growth medium having a pAg of about 9.8 to 13.5 and a temperature of 35° C. to 55° C.;

(d) discontinuing silver ion and iodide ion addition to the growth medium;

(e) elevating the temperature of the growth medium to increase the proportion of grains having a morphological configuration of four hexagonal bipyramids, each with bases joined to form a common tetrahedron and (f) resuming introduction of silver ions and iodide ions to continue growth of the silver iodide grains in the growth medium at a pAg of from about 9.8 to 13.5 and a temperature of from about 30° C. to 90° C.

2. A process according to claim 1, wherein from 5 mole percent to 50 mole percent of the total silver ion and iodide ion addition following step (b) occurs during step (f).

3. A process according to claim 1, wherein step (f) is conducted at a temperature of from 65° C. to 90° C. to truncate the grain bipyramids.

4. A process according to claim 1, wherein the last 2 to 25 percent of silver ion introduced subsequent to step (b) is introduced in step (f) with the growth medium maintained at a temperature of from 65° C. to 90° C. to truncate the grain bipyramids.

5. A process according to claim 1, wherein the growth medium comprises gelatin in an amount of 10 to 1000 grams per mole of silver.

6. A process according to claim 1, wherein step (e) is conducted at a temperature of from 60° C. to 90° C. for a period of 30 to 100 minutes.

7. A process according to claim 1, wherein step (a) is conducted at a pAg of from 5.8 to 8.4.

* * * * *